US010976141B2

(12) United States Patent
Sugimori

(10) Patent No.: US 10,976,141 B2
(45) Date of Patent: Apr. 13, 2021

(54) DART GAME APPARATUS AND PROGRAM

(71) Applicants: Kabushiki Kaisha SEGA Games, Tokyo (JP); Kabushiki Kaisha Dartslive, Tokyo (JP)

(72) Inventor: Yuji Sugimori, Tokyo (JP)

(73) Assignees: Kabushiki Kaisha SEGA Games, Tokyo (JP); Kabushiki Kaisha Dartslive, Tokyo (JP)

( * ) Notice: Subject to any disclaimer, the term of this patent is extended or adjusted under 35 U.S.C. 154(b) by 0 days.

(21) Appl. No.: 16/631,389

(22) PCT Filed: Jul. 30, 2018

(86) PCT No.: PCT/JP2018/028501
§ 371 (c)(1),
(2) Date: Jan. 15, 2020

(87) PCT Pub. No.: WO2019/026855
PCT Pub. Date: Feb. 7, 2019

(65) Prior Publication Data

US 2020/0217630 A1 Jul. 9, 2020

(30) Foreign Application Priority Data

Jul. 31, 2017 (JP) ..... JP2017-148404

(51) Int. Cl.
*F42B 6/00* (2006.01)
*F41J 3/02* (2006.01)
*F41J 5/18* (2006.01)

(52) U.S. Cl.
CPC ..... *F42B 6/003* (2013.01); *F41J 3/02* (2013.01); *F41J 5/18* (2013.01)

(58) Field of Classification Search
CPC . F41J 5/18; F41J 5/04; F41J 3/02; F41J 3/00; F41J 3/0009; F41J 3/0028; F41J 3/0042; F42B 6/003
(Continued)

(56) References Cited

U.S. PATENT DOCUMENTS 6,155,570 A * 12/2000 Allison ..... F41J 5/04 273/373
2007/0246887 A1 10/2007 Kagami et al.

FOREIGN PATENT DOCUMENTS

JP 2009-225880 A 10/2009
JP 2010-190487 A 9/2010
(Continued)

*Primary Examiner* — John E Simms, Jr.
*Assistant Examiner* — Rayshun K Peng
(74) *Attorney, Agent, or Firm* — Blank Rome LLP

(57) ABSTRACT

A dart game apparatus 100 is provided with: a dart board in which a dart can stick and a plurality of segments are demarcated; a first detecting part 100 that detects a position of a point where the dart stuck in the dart board; a second detecting part 102 that detects a segment of the point where the dart stuck from the plurality of segments; a correcting part 104 that corrects the position detected by the first detecting part 100 based on the segment detected by the second detecting part 102 if a segment corresponding to the position detected by the first detecting part 100 is different from the segment detected by the second detecting part 102; and an outputting part 106 that output the position detecting by the first detecting part 100 or position corrected by the correcting part 104.

6 Claims, 5 Drawing Sheets

(58) Field of Classification Search
USPC ..... 273/373
See application file for complete search history.

(56) References Cited

FOREIGN PATENT DOCUMENTS

| | | | |
|---|---|---|---|
| JP | 4682986 | | 2/2011 |
| JP | 2013-190120 | A | 9/2013 |
| KR | 10-2016-0132643 | A | 11/2016 |
| WO | WO 2016/182330 | A1 | 11/2016 |

* cited by examiner

DART GAME APPARATUS AND PROGRAM

CROSS REFERENCES TO RELATED APPLICATION

The present application is based on Japanese Application No. 2017-148404 filed on Jul. 31, 2017, and a description thereof is incorporated herein by reference.

TECHNICAL FIELD

The present invention relates to a dart game apparatus and a program.

BACKGROUND TECHNOLOGY

Technology related to a dart game apparatus provided with a dart board where a plurality of segments are demarcated is conventionally known, for example, using a photosensor to detect and output a position of a point where a dart sticks in the dart board (see Patent Document 1).

PRIOR TECHNOLOGY DOCUMENTS

Patent Documents

Patent Document 1: JP 4682986 B

SUMMARY

Technical Problem

However, with the technology, an error may occur in a detected position due to a dimensional error on a board surface, an angle at which the dart sticks, a dart shape, or the like. When an error occurs in the detected position, a segment of a point where the dart sticks may be incorrectly detected for example. In this case, a score obtained by a player who threw the dart is incorrectly calculated, and therefore, time and effort of correcting the mistake and the like are required, which hinders the progress of the dart game.

In view of the foregoing, an object of the present invention is to provide a dart game apparatus and a program capable of accurately outputting a position of a point where a dart sticks.

Means for Solving Problems

A dart game apparatus according to an aspect of the present invention is provided with: a dart board in which a dart can stick and a plurality of segments are demarcated; a first detecting part that detects a position of a point where the dart stuck in the dart board; a second detecting part that detects a segment of the point where the dart stuck from the plurality of segments; a correcting part that corrects the position detected by the first detecting part based on the segment detected by the second detecting part if a segment corresponding to the position detected by the first detecting part is different from the segment detected by the second detecting part; and an outputting part that output the position detecting by the first detecting part or position corrected by the correcting part.

According to the aforementioned aspect, if the segment corresponding to the position detected by the first detecting part is different than the segment detected by the second detecting part, the position detected by the first detecting part is corrected based on the segment detected by the second detecting part, and therefore, the position of the point where the dart sticks can be accurately output as compared to outputting the position detected by the first detecting part as is.

Effect of the Invention

According to the present invention, a position of a point where a dart sticks can be accurately output.

DESCRIPTION OF EMBODIMENTS

Figure 1:
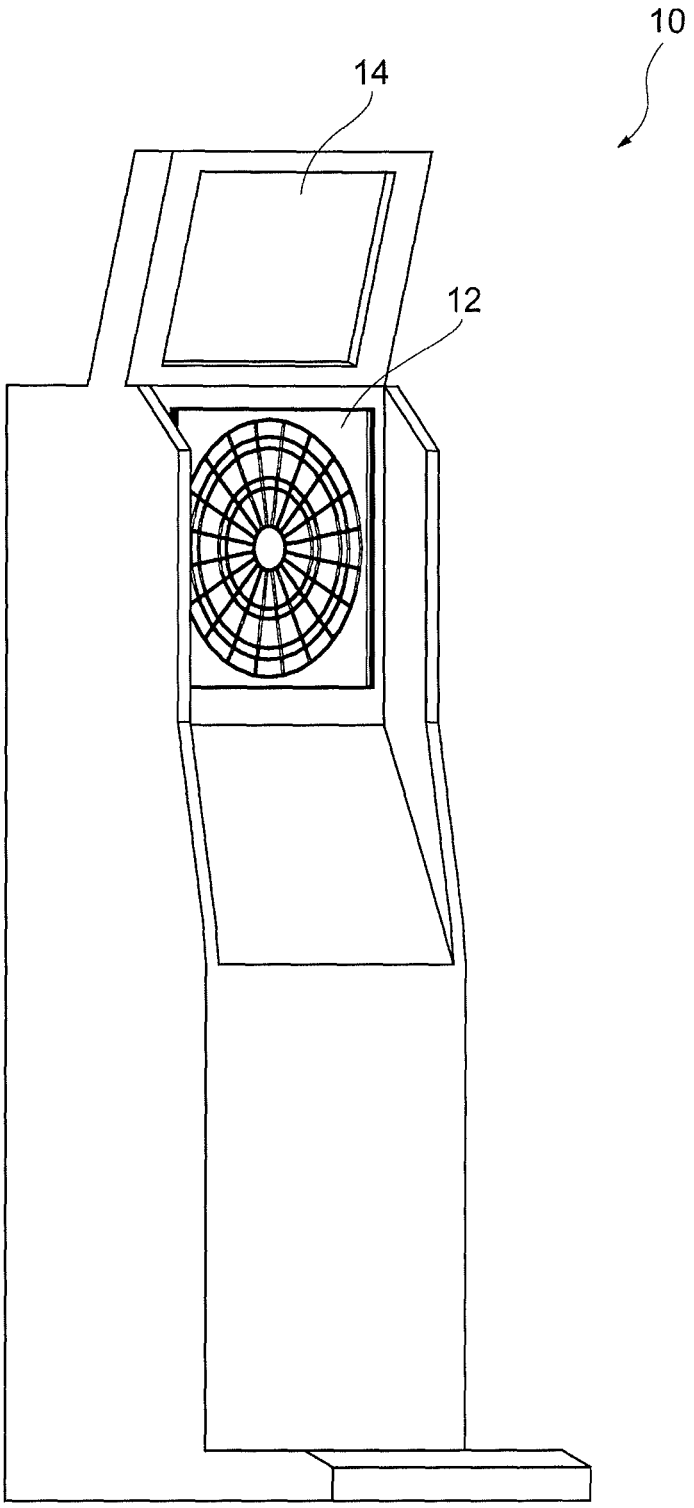
FIG. 1 is an external perspective view of a dart game apparatus according to an embodiment of the present invention.

A preferred embodiment of the present invention will be described below while referring to the attached drawings. Note that in the drawings, components with the same symbol have the same or a similar configuration.

<General Configuration>

FIG. 1 is an external perspective view of a dart game apparatus according to an embodiment of the present invention.

As illustrated in FIG. 1, a dart game apparatus 10 is formed into, for example, a vertical rectangular solid shape. The dart game apparatus 10 provides to a player, for example, a dart game where one player continuously throws a plurality of darts in one round or the like.

The dart game apparatus 10 is provided with dart board 12 and a displaying device 14. The dart board 12 is configured at an essentially eye-level position of a player standing, on a front surface of the dart game apparatus 10. The displaying device 14 displays a game image related to the dart game.

Furthermore, a coin insertion port, mode selecting switch, and the like not illustrated in the drawings are provided on the front surface of the dart game apparatus 10. The player inserts a fee into the coin insertion port, presses the mode selecting switch to select a game mode, and plays the dart game. With this dart game, the player stands at a predetermined position in front of the dart game apparatus 10 and throws a dart at a predetermined target on the dart board 12. A tip end portion of the dart that has reached the dart board 12 sticks into the dart board 12. A coordinate position of the stuck dart (for example, XY coordinate position with a center point on the dart board 12 as an origin. Hereinafter, simply referred to as "position".) is detected, and a score based on the sticking position is displayed on the displaying device 14. Note that the dart game apparatus 10 is described for business use, but may also be for home use. In this case, the coin insertion port or a card reader may be omitted.

Figure 2:
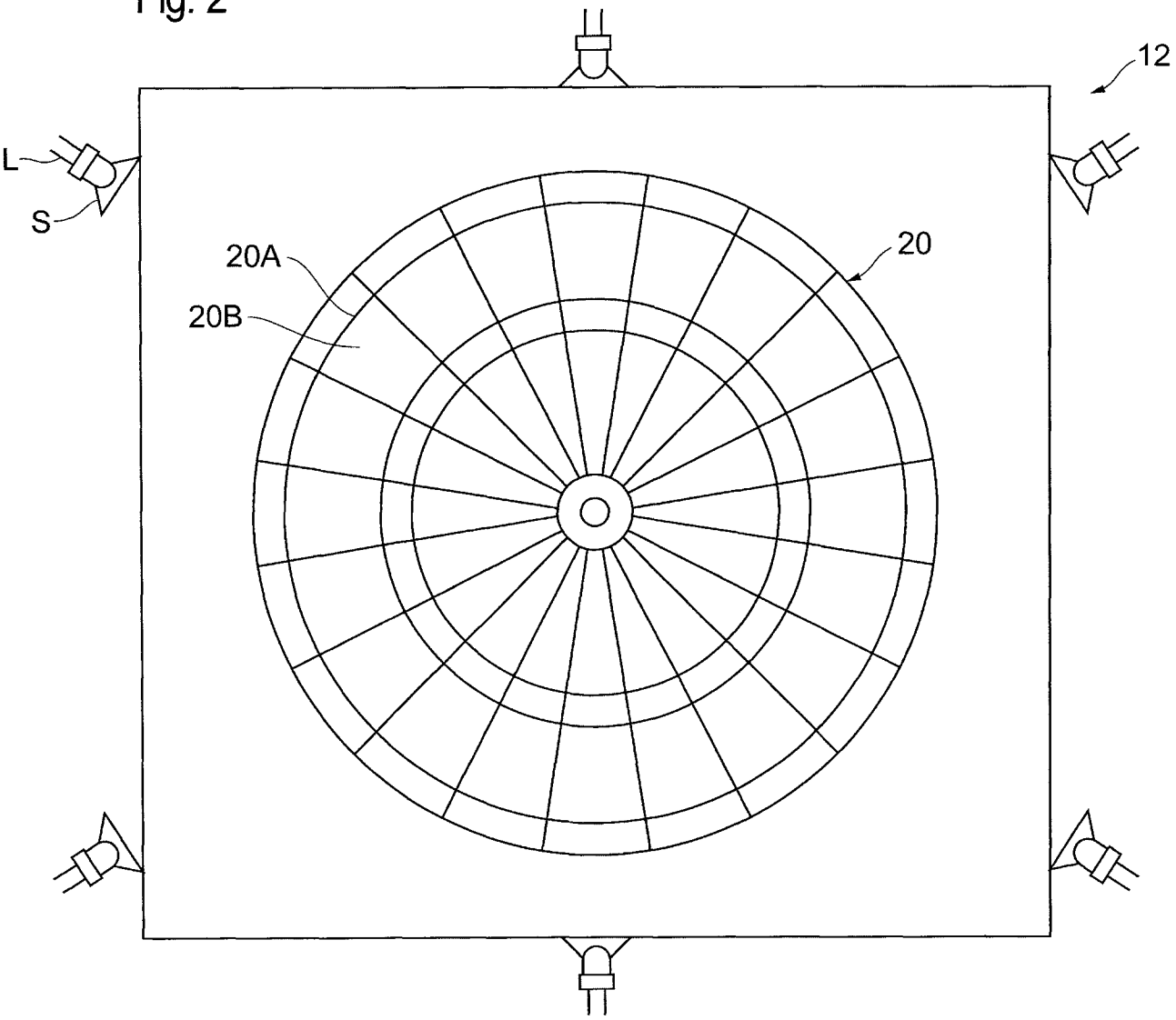
FIG. 2 is a front surface view of the dart board illustrated in FIG. 1.

FIG. 2 is a front surface view of the dart board 12 illustrated in FIG. 1.

As illustrated in FIG. 2, the dart board 12 is formed by, for example, a square plate when viewed from the front. A plurality of holes not illustrated in the drawings are formed such that a dart can stick on a board surface of the dart board 12. A circular region target 20 where the player can obtain a score when a dart sticks is formed on the board surface. The target 20 has a plurality of regions (segments 20B) demarcated by a partitioning wall 20A. The segments 20B are radially divided into scores that can be obtained by the player. Furthermore, when a surface of the board surface on a side where the target 20 is not formed is set as a back surface, the segments 20B can be displaced in a back surface direction when a dart sticks.

A plurality of light sources L and a plurality of photo-sensors S are disposed in a periphery of the dart board 12.

The plurality of light sources L emit light along the board surface of the dart board 12. The plurality of photo-sensors S receive the light emitted from the light sources L and convert the received light into an electrical signal to detect a light intensity of the light.

<Hardware Configuration>

Figure 3:
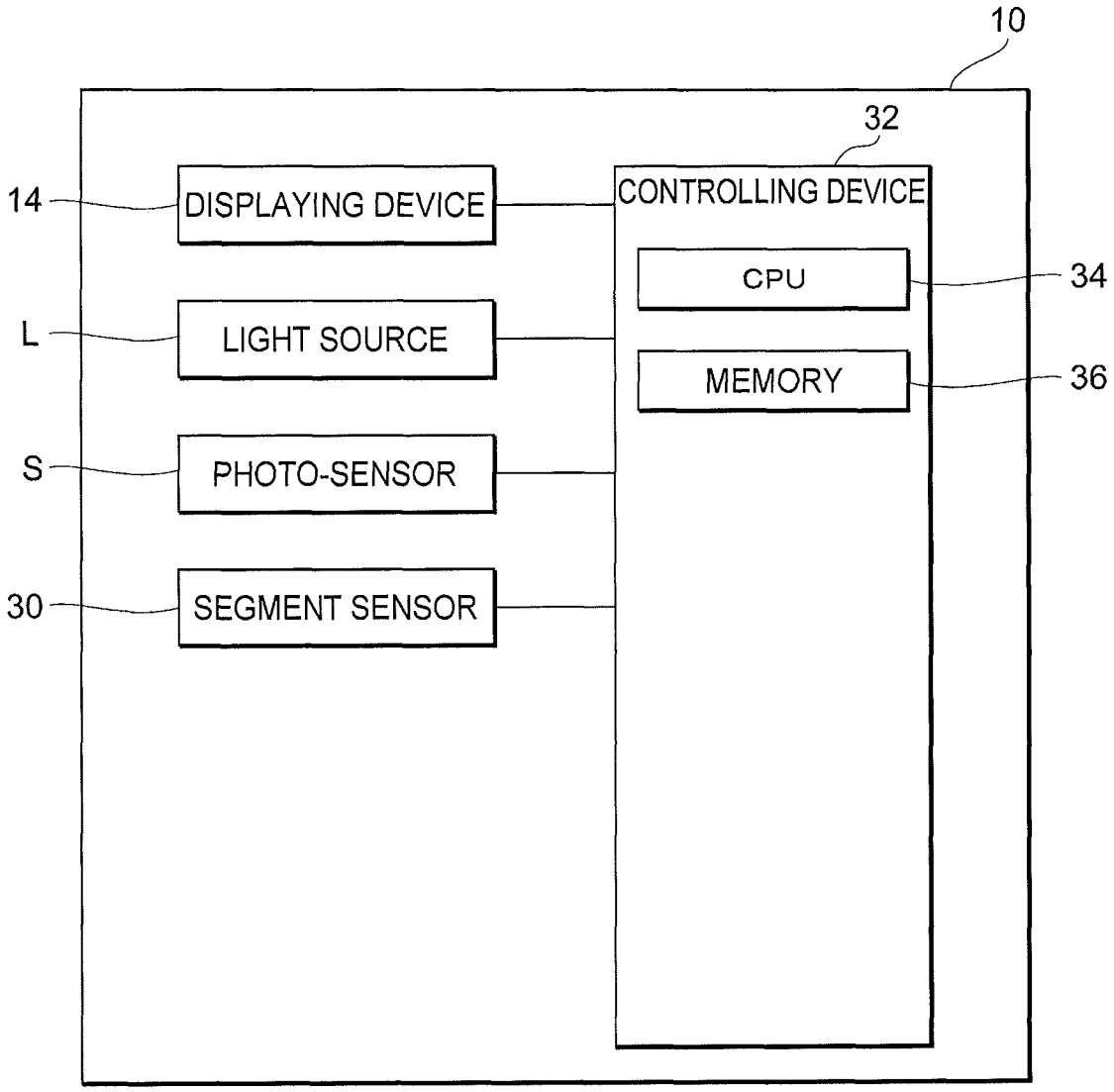
FIG. 3 is a block diagram illustrating an example of a hardware configuration of the dart game apparatus.

FIG. 3 is a block diagram illustrating an example of a hardware configuration of the dart game apparatus 10.

As illustrated in FIG. 3, the dart game apparatus 10 is provided with a plurality of segment sensors 30 and a control device 32 in addition to the displaying device 14, light source L, and photo-sensors S.

The segment sensors 30 are disposed on a back surface side of the segments 20B, and are pressure sensitive sensors that detect a displacement of the segment 20B toward the back surface direction by an impact of a sticking dart.

The displaying device 14, light source L, photo-sensors S, and segment sensors 30 are connected to the controlling device 32. The controlling device 32 is provided with a CPU 34 that controls a connection destination of the controlling device 32, and a memory 36 where a gaming program or data is stored.

The CPU 34, for example, reads the gaming program from the memory 36, and controls the progress of the dart game in accordance with the read gaming program. The player plays a game by throwing a dart at the target 20 of the dart board 12 at a predetermined distance from the dart game apparatus 10 to stick into the board surface of the dart board 12. When the dart thrown by the player at the target 20 on the board surface sticks into the board surface, the light intensity of the light received by the photo-sensor S changes based on the dart shielding the light. At least two photo-sensors S detect the light intensity, and then a position of a point where the dart sticks is calculated by the CPU 34 based on triangulation using the light intensity of the two photo-sensors S. Furthermore, the CPU 34 reads a score corresponding to the calculated position from a table stored in the memory 36, and then causes the displaying device 14 to change a target image or display a score.

<Functional Block Configuration>

Figure 4:
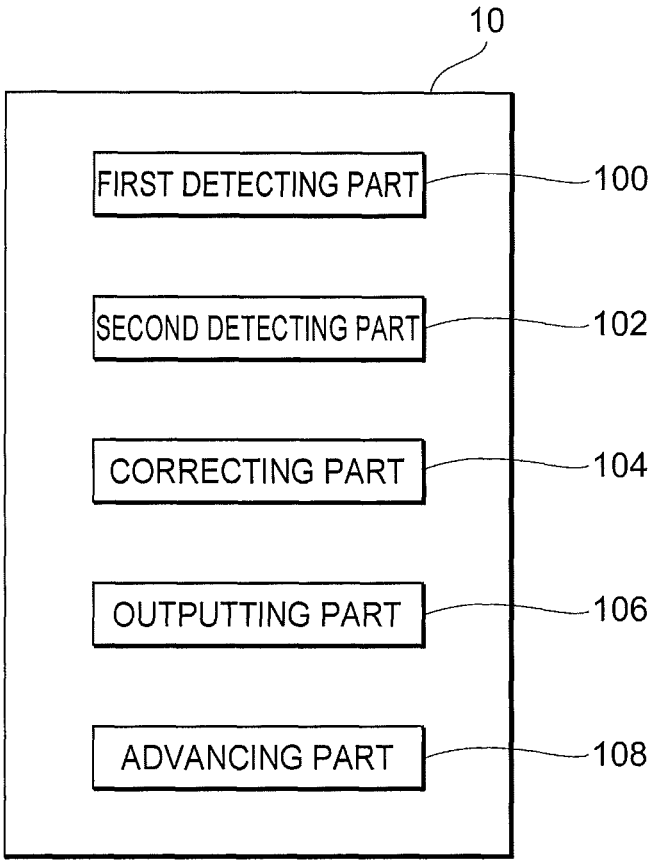
FIG. 4 is a block diagram illustrating an example of a functional configuration of the dart game apparatus.

FIG. 4 is a diagram illustrating an example of a functional block configuration of the dart game apparatus 10.

As illustrated in FIG. 4, the dart game apparatus 10 is provided with functional parts including a first detecting part 100, a second detecting part 102, a correcting part 104, an outputting part 106, an advancing part 108, and the like.

The first detecting part 100 is implemented by the plurality of light source L, plurality of photo-sensors S, CPU 34, and the like. The first detecting part 100 is a functional part that detects a position of point where a dart sticks in the dart board 12.

The second detecting part 102 is implemented by the plurality segment sensors 30, CPU 34, and the like. The second detecting part 102 is a functional part that detects a segment where a dart sticks from the plurality of segments 20B.

The correcting part 104 is implemented by the CPU 34 executing the gaming program. The correcting part 104 is a functional part that corrects the position detected by the first detecting part 100 based on the segment detected by the second detecting part 102 if a segment 20B corresponding to the position detected by the first detecting part 100 is different from the segment 20B detected by the second detecting part 102. For example, the correcting part 104 may correct the position detected by the first detecting part 100 to a position in the segment detected by the second detecting part 102, or may correct the position detected by the first detecting part 100 to a segment side detected by the second detecting part 102 within a segment corresponding to the position. For example, the correcting part 104 calculates a position within a predetermined radius of the position detected by the first detecting part 100 within the segment detected by the second detecting part 102, and corrects the position detected by the first detecting part 100 to the calculated position. In the present embodiment, of positions within a predetermined radius, in particular, a position nearest to the position detected by the first detecting part 100 is calculated, and the position detected by the first detecting part 100 is corrected to the calculated nearest position.

Note that the "nearest position" refers to a position within the segment detected by the second detecting part 102, which is nearest to a foot of a perpendicular line when a perpendicular line is extended down from the position detected by the first detecting part 100 to the partitioning wall 20A of the segment side detected by the second detecting part 102. However, if the position detected by the first detecting part 100 is near a vertex where the partitioning wall 20A intersects, the "nearest position" may be a position within a segment near the vertex.

The outputting part 106 is implemented by the CPU 34 executing the gaming program. The position detected by the first detecting part 100 or position corrected by the correcting part 104 is output. An output destination is not particularly limited, but is the displaying device 14, advancing part 108, or the like.

The advancing part 108 is implemented by the CPU 34 executing the gaming program. The advancing part 108 is a functional part that advances a dart game based on the position output by the outputting part 106. For example, the advancing part 108 advances a dart game by determining a score given to the player, based on the position output by the outputting part 106.

<Process Flow>

Figure 5:
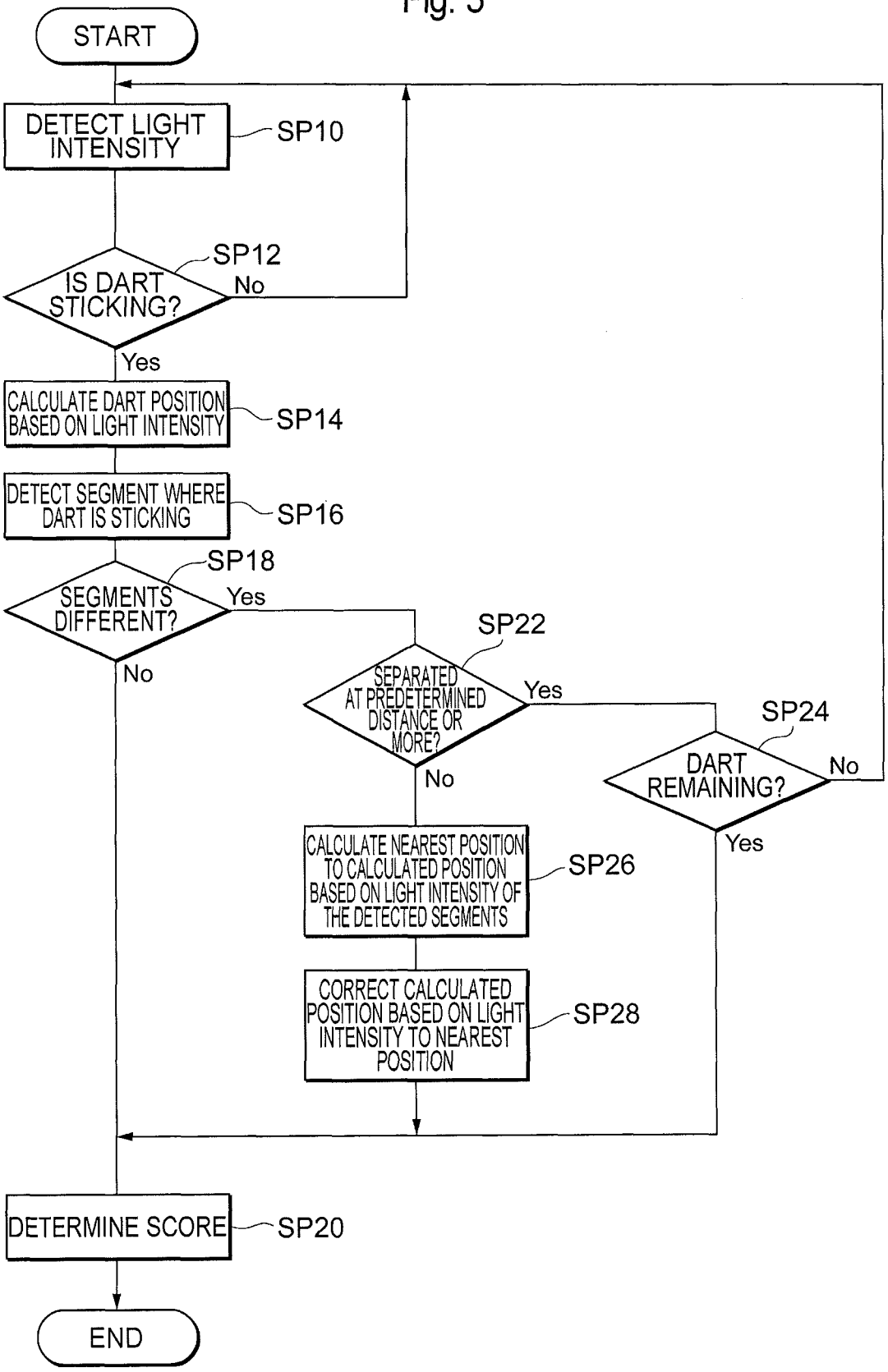
FIG. 5 is a flowchart showing a process flow of functional parts illustrated in FIG. 4.

FIG. 5 is a flowchart showing a process flow of the functional parts 100 to 108 illustrated in FIG. 4. The process is repeated for each dart throw. Note that a process order described below is one example and may be appropriately changed.

(Step SP10)

The first detecting part 100 detects the light intensity of light from the light source L. Furthermore, the process moves to a process of step SP12.

(Step SP12)

The first detecting part 100 determines whether or not a dart is stuck to the dart board 12 based on the light intensity. If determined to be affirmative, the process moves to a process of step SP14, and if determined to be negative, the process returns to the process of step SP10. Note that an impact sensor that detects the presence or absence of an impact is provided on the dart board 12, and whether or not a dart is stuck may be determined based on a signal output from the impact sensor. Furthermore, whether or not a dart has stuck may be determined based on a signal output from an impact sensor, a light intensity, or a segment detected by the second detecting part 102.

(Step SP14)

The first detecting part 100 calculates (detects) a position of the dart based on the detected light intensity. Furthermore, the process moves to a process of step SP16.

(Step SP16)

The second detecting part 102 detects a segment where the dart sticks from the plurality of segments 20B. Furthermore, the process moves to a process of step SP18.

(Step SP18)

The correcting part 104 determines whether or not a segment corresponding to the position detected by the first detecting part 100 is different from the segment detected by the second detecting part 102. Furthermore, if determined to be affirmative, the process moves to a process of step SP22, and if determined to be negative, the process moves to a process of step SP20.

(Step SP20)

The outputting part 106 outputs the position detected by the first detecting part 100 or a position corrected by the correcting part 104 as described later to the displaying device 14 and advancing part 108. The displaying device 14 displays the position output from the outputting part 106. Furthermore, the advancing part 108 determines a score based on the position output from the outputting part 106. Furthermore, the series of processes ends.

(Step SP22)

The correcting part 104 determines whether or not a point of the position detected by the first detecting part 100 and a reference point within the segment detected by the second detecting part 102 are separated by a predetermined distance or more. The "reference point" may be a center position in the segment detected by the second detecting part 102, or may be a position nearest the position detected by the first detecting part 100 within the segment detected by the second detecting part 102. Note that if the position within the segment is the nearest position, a process of step SP26 described later is omitted. Furthermore, the "predetermined distance" is appropriately determined based on the accuracy of the photo-sensors S, pitch of the holes where a dart sticks, distance between the partitioning wall 20A and holes, and the like. The "predetermined distance" may be different for each segment corresponding to a position detected by the first detecting part 100, such as 1 cm, 2 cm, and the like. Furthermore, if the determination is determined to be affirmative, the process moves to a process of step SP24, and if determined to be negative, the process moves to a process of step SP26.

(Step SP24)

The correcting part 104 determines whether or not a dart remains on the dart board 12 based on a light intensity detected by the first detecting part 100. Furthermore, if determined to be affirmative, the process moves to the process of step SP20, and if determined to be negative, the process returns to the process of step SP10.

(Step SP26)

If determined to be negative in step SP22, the correcting part 104 calculates a position nearest to the position detected by the first detecting part 100 within the segment detected by the second detecting part 102. In other words, the correcting part 104 calculates the nearest position under a condition where the distance between the reference point within the segment detected by the second detecting part 102 and the point of the position detected by the first detecting part 100 is less than the predetermined distance. Furthermore, the process moves to a process of step SP28.

(Step SP28)

The correcting part 104 corrects the position detected by the first detecting part 100 to the nearest position calculated by the step SP26. Furthermore, the process moves to the process of step SP20. Thereby, in step SP20, the advancing part 108 determines a score based on the position corrected by the correcting part 104.

With the present embodiment as described above, the dart game apparatus 10 corrects the position detected by the first detecting part 100 based on the segment detected by the second detecting part 102 if the segment corresponding to the position detected by the first detecting part 100 is different than the segment detected by the second detecting part 102, and therefore, the position of the point where the dart sticks can be accurately output as compared to outputting the position detected by the first detecting part 100 as is.

Furthermore, with the present embodiment, the dart game apparatus 10 corrects the position detected by the first detecting part 100 to the position in the segment detected by the second detecting part 102 if the segment corresponding to the position detected by the first detecting part 100 is different from the segment detected by the second detecting part 102. Thereby, a position of a dart in a correct segment where the dart actually sticks can be output. If the position is in a correct segment, progress of the dart game does not change at any position (a score and the like does not change), and therefore, the position corrected by the correcting part 104 is output without manually changing the position detected by the first detecting part 100. Thus, the dart game can be efficiently advanced.

Furthermore, with the present embodiment, the dart game apparatus 10 calculates a position within the segment detected by the second detecting part 102 and within a predetermined radius of the position detected by the first detecting part 100, and then corrects the position detected by the first detecting part 100 to the calculated position, if the segment corresponding to the position detected by the first detecting part 100 is different from the segment detected by the second detecting part 102, as described above. Thereby, a position of a point where a dart actually sticks can be more accurately output.

Furthermore, with the present embodiment, the dart game apparatus 10 calculates a position nearest to the position detected by the first detecting part 100 within the segment detected by the second detecting part 102, and then corrects the position detected by the first detecting part 100 to the calculated nearest position, if the segment corresponding to the position detected by the first detecting part 100 is different from the segment detected by the second detecting part 102, as described above. Thereby, a position of a point where a dart actually sticks can be more accurately output.

Furthermore, according to the present embodiment, the dart game apparatus 10 corrects the position detected by the first detecting part 100 under a condition where the distance between the reference point with the segment detected by the second detecting part 102 and position detected by the first detecting part 100 is less than a predetermined distance, if the segment corresponding to the position detected by the first detecting part 100 is different from the segment detected by the second detecting part 102, as described above. As described above, when the reference point of the segment detected by the second detecting part 102 and position detected by the first detecting part 100 are separated at a predetermined distance or more, there is a high possibility that the segment detected by the second detecting part 102 is not a segment where the dart is sticking. Therefore, correcting under a condition where the distance is less than the predetermined distance can suppress the position detected by the first detecting part 100 from being corrected and output based on an incorrect segment.

Modified Example

Note that the present invention is not limited to the aforementioned embodiments. In other words, an embodiment where an appropriate design change is added by a person with ordinary skill in the art to the aforementioned embodiment is included in the scope of the present invention so long as the characteristics of the present invention are provided. Furthermore, elements provided by the aforementioned embodiment can be combined as much as technically possible, and the combination thereof is included in the scope of the present invention so long as the characteristics of the present invention are included.

For example, in the aforementioned embodiment, a case was described where the first detecting part 100 is implemented by the plurality of light sources L, plurality of photo-sensors S, CPU 34, and the like, but the first detecting part 100 may be implemented by a laser scanner and the CPU 34, a camera and the CPU 34, or the like.

Furthermore, in addition to the aforementioned embodiment, a re-detection button that causes the first detecting part 100 to again detect a position of a point where a dart is sticking in the dart board 12 may be provided in the dart game apparatus 10. The re-detection button is pressed, for example, when the player determines that the position detected by the first detecting part 100 or position corrected by the correcting part 104 is incorrect.

Furthermore, in addition to the aforementioned embodiment, a correcting function that corrects the position detected by the first detecting part 100 or position corrected by the correcting part 104 may be provided in the dart game apparatus 10.

Furthermore, in the aforementioned embodiment, a case was described where the position detected by the first detecting part 100 is corrected to a position with the segment detected by the second detecting part 102, if a segment corresponding to the position detected by the first detecting part 100 is different from the segment detected by the second detecting part 102. However, of the two segments, the segment with a corresponding higher score or corresponding lower score may be determined, and then the position of detected by the first detecting part 100 may be corrected to the position with the determined segment.

Note that if the segment corresponding to the position detected by the first detecting part 100 is the same as the determined segment, correction does not need to be performed.

Note that in the aforementioned embodiment, "part" does not simply refer to physical means, but also includes cases where a function provided by the "part" is implemented by software. Furthermore, even if one function provided by the "part" or a device is implemented by two or more physical means or devices, two or more functions of the "part" or device may be implemented by one physical means or device.

REFERENCE SINGS LIST

10 Dart game apparatus
12 Dart board
20B Segment
100 First detecting part
102 Second detecting part
104 Correcting part
106 Outputting part
108 Advancing part

What is claimed:

1. A dart game apparatus comprising:
a dart board in which a dart can stick and a plurality of segments are demarcated;
a plurality of photo-sensors configured to receive light from light sources;
a plurality of segment sensors configured to detect an impact of a sticking dart; and
a processor configured to:
detect a position of a point where the sticking dart sticks in the dart board based on a light intensity detected by at least two photo-sensors of the plurality of photo-sensors, where the light intensity is changed by the sticking dart;
detect a segment of the point where the sticking dart sticks, from the plurality of segments, based on an impact detected by at least one segment sensor of the plurality of segment sensors;
correct the detected position based on the detected segment if a segment corresponding to the detected position is different from the detected segment; and
output the detected position or the corrected position on a displaying device.

2. The dart game apparatus according to claim 1, wherein the processor is configured to correct the detected position to a position in the detected segment if a segment corresponding to the detected position is different from the detected segment.

3. The dart game apparatus according to claim 2, wherein the processor is configured to calculate a position within the detected segment and within a predetermined radius of the detected position, and to then correct the detected position to the calculated position, if a segment corresponding to the detected position is different from the detected segment.

4. The dart game apparatus according to claim 2, wherein the processor is configured to calculate a position within the detected segment and nearest to the detected position, and to then correct the detected position to the calculated nearest position, if a segment corresponding to the detected position is different from the detected segment.

5. The dart game apparatus according to claim 1, wherein the processor is configured to correct the detected position under a condition where a distance between a reference point within the detected segment and the detected position is less than a predetermined distance, if a segment corresponding to the detected position is different from the detected segment.

6. A program that operates a dart game apparatus,
wherein the dart game apparatus comprises:
a dart board in which a dart can stick and a plurality of segments are demarcated;
a plurality of photo-sensors configured to receive light from light sources;
a plurality of segment sensors configured to detect an impact of a sticking dart; and
a processor; and
wherein the program causes the processor to execute:
detecting a position of a point where the sticking dart sticks in the dart board based on a light intensity detected by at least two photo-sensors of the plurality of photo-sensors, wherein the light intensity is changed by the sticking dart;

detecting a segment of the point where the sticking dart sticks, from the plurality of segments, based on an impact detected by at least one segment sensor of the plurality of segment sensors;

correcting the detected position based on the detected segment if a segment corresponding to the detected position is different from the detected segment; and outputting the detected position or the corrected position on a displaying device.

* * * * *